US005890267A

United States Patent [19]

Neuhofer, Jr.

[11] Patent Number: 5,890,267

[45] Date of Patent: Apr. 6, 1999

[54] ATTACHMENT FITTING FOR LONGITUDINALLY GROOVED COVERING STRIPS

[76] Inventor: Franz Neuhofer, Jr., Haslau 56, A-4893 Zell am Moos, Austria

[21] Appl. No.: 3,491

[22] Filed: Jan. 6, 1998

[30] Foreign Application Priority Data

Jan. 9, 1997 [AT] Austria ..... 20/97

[51] Int. Cl.[6] ..... A44B 21/00; E04F 19/00

[52] U.S. Cl. ..... 24/295; 24/290; 52/718.05; 411/84

[58] Field of Search ..... 24/295, 289, 290, 24/297; 52/718.05, 718.01, 288.1, 287.1; 411/84, 85, 544

[56] References Cited

U.S. PATENT DOCUMENTS

| | | | |
|---|---|---|---|
| 1,688,134 | 10/1928 | Braunstein | 52/287.1 |
| 3,235,929 | 2/1966 | Sweeney et al. | 24/295 |
| 3,302,350 | 2/1967 | Brown et al. | 52/718.05 |
| 3,405,488 | 10/1968 | Nelson | 52/288.1 |
| 4,150,517 | 4/1979 | Warner, Sr. | 52/288.1 |

FOREIGN PATENT DOCUMENTS

| | | | |
|---|---|---|---|
| 000 264 | 6/1995 | Austria . | |
| 0 227 342 | 7/1987 | European Pat. Off. . | |
| 1248702 | 1/1959 | France . | |
| 40 13 459 | 1/1991 | Germany . | |
| 488079 | 3/1970 | Switzerland . | |
| 0546375 | 7/1942 | United Kingdom | 24/295 |
| 0678603 | 9/1952 | United Kingdom | 24/295 |
| 0783206 | 9/1957 | United Kingdom | 24/295 |
| 1105025 | 3/1968 | United Kingdom . | |

*Primary Examiner*—Victor N. Sakran
*Attorney, Agent, or Firm*—Collard & Roe, P.C.

[57] ABSTRACT

An attachment fitting (1) for longitudinally grooved covering strips (12) consists of a holding member (2) of U-shaped cross-section, which in the middle area of its leg portion (21) has a mounting hole (3) and adjacent the ends of its leg portions (22) has bent holding straps (24). To obtain a fitting suited for being mounted at an inside edge, the holding member (2) is provided with transition portions (23) between the web portion (21) and the leg portions (22), which transition portions are symmetrical to the central longitudinal plane (E) and flatten the external corner portions.

3 Claims, 2 Drawing Sheets

Figure 5:
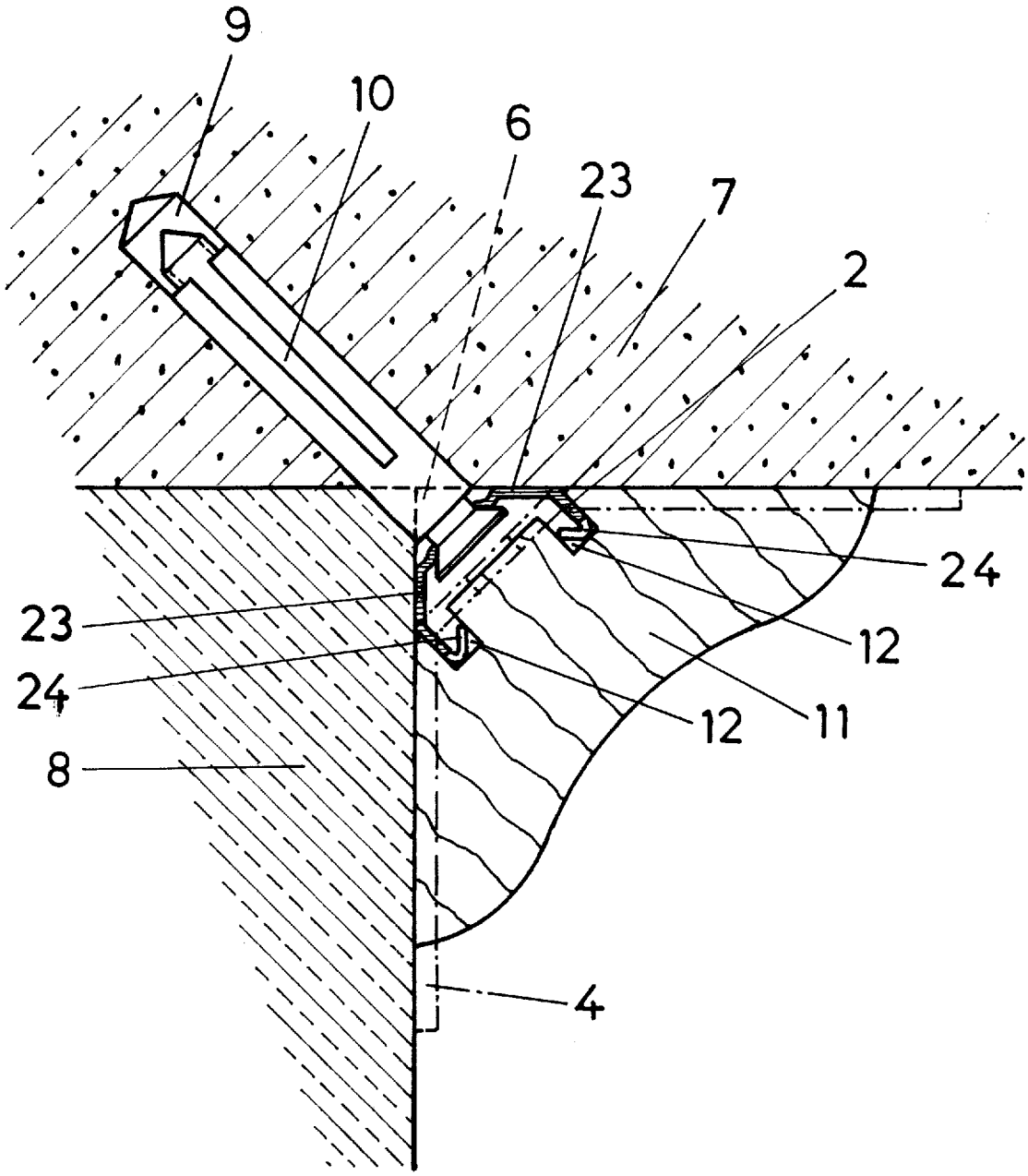

FIG.1
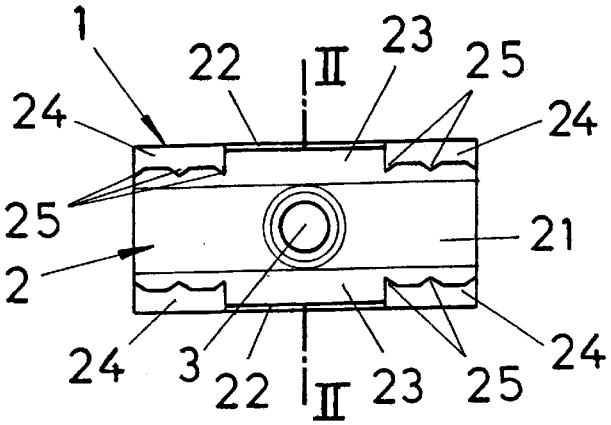
FIG.2
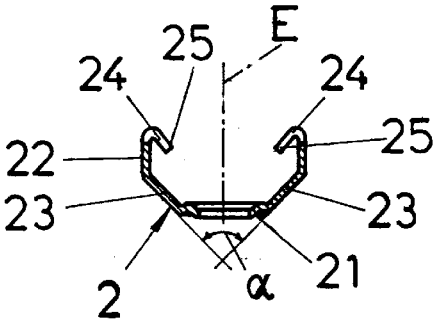
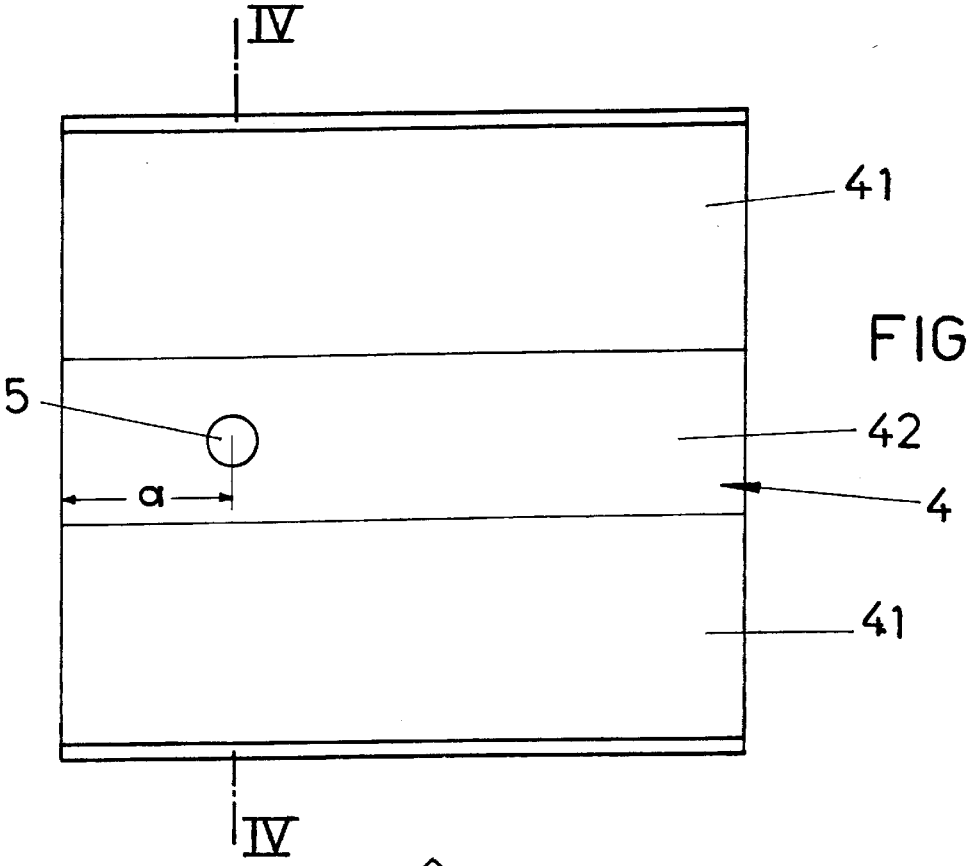
FIG.3
FIG.4
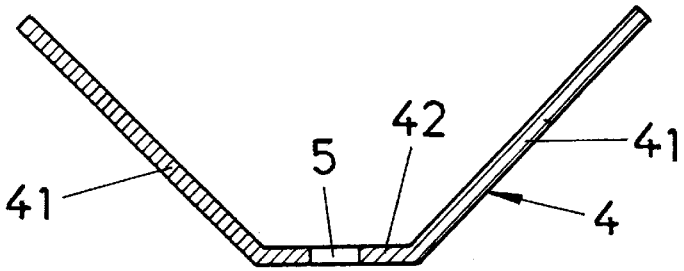

ATTACHMENT FITTING FOR LONGITUDINALLY GROOVED COVERING STRIPS

This invention relates to an attachment fitting for longitudinally grooved covering strips, comprising a holding member of U-shaped cross-section, which in the middle area of its web portion has a mounting hole and adjacent the ends of its leg portions has bent holding straps.

Such attachment fittings are known from the DE 40 13 459 A or the AT 000 264 U, and are used for the clip-like attachment of covering strips, such as skirting boards or other types of banding or surbase, which strips can be clampingly mounted on the preassembled fittings by means of longitudinal grooves whose arrangement and cross-section have been adapted to the holding straps, so that an invisible attachment is possible and the strips can be assembled and, if necessary, also be disassembled without separate screwing or nailing. The known holding members generally have leg portions directly protruding from the web portion at right angles, so that they require a flat wall surface for their assembly and are not suited for attachment in a groove or inside edge. However, this repeatedly leads to difficulties in mounting the attachment fittings in the vicinity of an inside edge, either a bottom edge, a wall edge, a ceiling edge or the like, as merely for space reasons drilling the mounting holes for the holding members on one of the edge-defining walls is rather complicated and frequently leads to damages of the wall portions or produces inclined drilled holes.

It is therefore the object underlying the invention to eliminate these deficiencies and create an attachment fitting as described above, which properly holds the covering strips and is chiefly suited for fixing the same in the vicinity of an inside edge.

This object is solved by the invention in that the holding member is provided with transition portions between the web portion and the leg portions, which transition portions are symmetrical to the central longitudinal plane and flatten the external corner portions. By means of these simple measures, the holding member can diagonally be inserted adjacent the inside edge and be fixed directly in the groove. The web portion bridges the actual line of the edge, and the adjoining transition portions provide for a support of the holding member on both sides of the two edge-forming wall portions, so that by means of a fastening screw a proper, stable assembly of the holding member in the inside edge is ensured. The leg portions, which thus form an angle of about 45° with respect to the wall portions and have bent holding straps adapted to perform a clamping or locking function by means of catches, claws or the like, provide for a proper snap mounting of the strips, which now likewise diagonally bridge the inside edge and on their back side have corresponding grooves to be mounted on the holding straps. Since the basic shape of the holding members is maintained despite the transition portions, it is in addition possible to closely fit these holding members as usual with their web portion on a flat wall surface and also use these holding members for a wall assembly.

The transition portions as such might be designed as rounded portions, which are preferred for instance for a strip attachment in the case of flutes. For the inside edge portion, as it mostly exists in the case of living rooms, there are expediently available transition portions in the form of straight bevels, where the inclined transition portions include a normal angle, so that the abutment of the transition portions against the edge-forming wall portions provides for an exact determination of the position of the holding members and together with the attachment provides for a proper positioning inside the edge portion.

Since in the case of buildings wall portions of a different construction, such as brick walls and concrete ceilings, are often abutting in the edge portion, drilling attachment holes for setting the attachment fittings may create some difficulties, so that in accordance with a further aspect of the invention a drilling template is associated to the holding member, which drilling template consists of an angle bar member having legs disposed at right angles to each other and a top web disposed isogonally with respect to the legs, where the top web at least has the same width as the web portion of the holding member and has at least one drilled hole in the middle of the width, which drilled hole is preferably spaced from the end face of the angle bar member by half the length of the holding member. Such drilling template can easily be inserted in the inside edge portion and then provides a perfect drilling jig for drilling the mounting hole, which provides for exactly setting the drilled holes in the inside edge along the angular line of symmetry. Since the distance of the drilled holes from the end face of the angle bar has been adapted to the holding members, the drilling template may also be used as a measure for the length of the holding member and define the required corner distance or the like for the fittings.

In the drawing, the subject-matter of the invention is represented by way of example, wherein:

FIGS. 1 and 2 represent an inventive attachment fitting in a top view and in a cross-section along line II—II of FIG. 1, FIGS. 3 and 4 represent an associated drilling template in a top view and in a cross-section along line IV—IV of FIG. 3, and FIG. 5 represents a schematic cross-section of a covering strip mounted by means of the inventive attachment fitting.

An attachment fitting 1 for snap-mounting longitudinally grooved covering strips consists of a holding member 2 of U-shaped cross-section including a web portion 21, two leg portions 22 and transition portions 23 between the web portion 21 and the leg portions 22, which transition portions flatten the external corner portions. In the middle area of the web portion 21 a mounting hole 3 is provided for the screw attachment of the holding member 2, and adjacent the ends of the leg portions 22 bent holding straps 24 are provided, which have claws 25 for holding the mounted covering strips.

The transition portions 23 have the shape of straight bevels disposed symmetrically with respect to the central longitudinal plane E of the holding member 2 and include a normal angle $\alpha$, so that the holding member 2 may optionally be attached and fixed on a flat wall with the web portion 21 or on the two edge-forming wall surfaces of an inside edge with the transition portions 23.

As a mounting aid, the attachment fitting 1 comprises a drilling template of an angle bar member 4 having two legs 41 disposed at right angles to each other and a top web 42 disposed isogonally with respect to the legs, where in the top web 42 a drilled hole 5 is provided. The drilled hole lies in the middle of the width of the top web 42, which is broader than the web portion 21, and at a distance a from an end face of the angle bar member 4 which corresponds to half the length of the holding member 2.

The inventive attachment fitting 1 is above all suited for the attachment of covering strips on the inside edge, for which purpose, as indicated in FIG. 5, the drilling template 4 is first of all used for drilling correspondingly spaced mounting holes 9 in the angular line of symmetry along the inside edge 6 between ceiling 7 and wall 8 of a room. Then, it is merely necessary to fasten the holding members 2 by means of appropriate fastening screws 10, where together with the screwing operation a proper positioning of the holding members 2 is effected by abutting the transition portions 23 against the edge-forming wall surfaces 7, 8, and after mounting the holding members 2, the covering strips 11 can be clampingly snapped onto the holding straps 24 of the holding members 2 by means of their longitudinal grooves 12 provided on the back side.

I claim:

1. An attachment fitting for a covering strip defining two longitudinally extending grooves, which comprises a holding member of U-shaped cross-section, the holding member comprising (a) a web portion having a mounting hole in a central longitudinal plane of symmetry extending perpendicularly to the web portion, (b) two leg portions extending parallel and symmetrically to the plane of symmetry at respective sides thereof, the leg portions having free ends and comprising (a) inwardly bent holding straps at the free ends thereof, the leg portions and holding straps being adapted to fit into the longitudinally extending grooves of the covering strip for clamping the covering strip to the attachment fitting, and (c) two transition portions connecting the leg portions to the web portion and extending symmetrically to the plane of symmetry.

2. The attachment fitting of claim 1, wherein the transition portions enclose a normal angle.

3. In combination: an attachment fitting for a covering strip defining two longitudinally extending grooves and a drilling template, the attachment fitting comprising a holding member of U-shaped cross-section, the holding member comprising (a) a web portion having a mounting hole in a central longitudinal plane of symmetry extending perpendicularly to the web portion, (b) two leg portions extending parallel and symmetrically to the plane of symmetry at respective sides thereof, the leg portions having free ends and comprising (1) inwardly bent holding straps at the free ends thereof, the leg portions and holding straps being adapted to fit into the longitudinally extending grooves of the covering strip for clamping the covering strip to the attachment fitting, and (c) two transition portions connecting the leg portions to the web portion and extending symmetrically to the plane of symmetry; and the drilling template being an angle bar member comprising (d) two legs enclosing a normal angle and (e) a top web connecting the legs and disposed isogonally with respect to the legs, the top web having (1) at least the same width as the web portion of the attachment fitting, and (2) a hole in the middle of the width and spaced from an end of the top web by half the length of the web portion of the attachment fitting.

* * * * *